US009059545B2

(12) United States Patent
Mason et al.

(10) Patent No.: US 9,059,545 B2
(45) Date of Patent: Jun. 16, 2015

(54) SOCKET CONNECTORS AND METHODS OF ASSEMBLING SOCKET CONNECTORS

(75) Inventors: Jeffery Walter Mason, North Attleboro, MA (US); Wayne Stewart Alden, III, Whitman, MA (US)

(73) Assignee: Tyco Electronics Corporations, Berwyn, PA (US)

( * ) Notice: Subject to any disclaimer, the term of this patent is extended or adjusted under 35 U.S.C. 154(b) by 258 days.

(21) Appl. No.: 13/546,464

(22) Filed: Jul. 11, 2012

(65) Prior Publication Data

US 2014/0017942 A1 Jan. 16, 2014

(51) Int. Cl.

| | |
|---|---|
| ***H01R 12/00*** | (2006.01) |
| ***H01R 12/71*** | (2011.01) |
| ***H01R 12/73*** | (2011.01) |
| ***H01R 13/24*** | (2006.01) |

(52) U.S. Cl.

CPC ..... *H01R 12/714* (2013.01); *Y10T 29/49208* (2015.01); *H01R 12/73* (2013.01); *H01R 13/2421* (2013.01)

(58) Field of Classification Search

CPC ..... H01R 23/722
USPC ..... 439/66, 91, 63, 607.1, 607.09
See application file for complete search history.

(56) References Cited

U.S. PATENT DOCUMENTS

| | | | | |
|---|---|---|---|---|
| 4,200,351 | A | 4/1980 | Long et al. | |
| 4,511,196 | A * | 4/1985 | Schuler et al. | 439/96 |
| 4,906,194 | A * | 3/1990 | Grabbe | 439/71 |
| 4,961,709 | A * | 10/1990 | Noschese | 439/66 |
| 5,174,763 | A * | 12/1992 | Wilson | 439/66 |
| 5,211,567 | A * | 5/1993 | Neumann et al. | 439/74 |
| 5,380,210 | A * | 1/1995 | Grabbe et al. | 439/66 |
| 5,562,462 | A * | 10/1996 | Matsuba et al. | 439/70 |
| 5,618,188 | A * | 4/1997 | Gilmore et al. | 439/91 |
| 5,795,162 | A * | 8/1998 | Lambert | 439/63 |
| 6,027,345 | A * | 2/2000 | McHugh et al. | 439/66 |
| 6,033,233 | A * | 3/2000 | Haseyama et al. | 439/66 |
| 6,203,329 | B1 * | 3/2001 | Johnson et al. | 439/66 |
| 6,231,352 | B1 * | 5/2001 | Gonzales | 439/66 |
| 6,247,939 | B1 * | 6/2001 | Bestul et al. | 439/66 |
| 6,264,476 | B1 * | 7/2001 | Li et al. | 439/66 |
| 6,452,406 | B1 * | 9/2002 | Beaman et al. | 324/755.01 |
| 6,462,567 | B1 | 10/2002 | Vinther et al. | |
| 6,471,525 | B1 * | 10/2002 | Fan et al. | 439/70 |
| 6,590,478 | B2 * | 7/2003 | Pluymers | 333/246 |
| 6,686,732 | B2 * | 2/2004 | Parrish | 324/756.05 |
| 6,712,620 | B1 * | 3/2004 | Li et al. | 439/63 |
| 6,746,252 | B1 | 6/2004 | Scott | |
| 6,776,668 | B1 * | 8/2004 | Scyoc et al. | 439/700 |
| 6,837,724 | B2 * | 1/2005 | McDaid et al. | 439/188 |
| 6,932,618 | B1 * | 8/2005 | Nelson | 439/66 |
| 6,989,681 | B2 | 1/2006 | Maekawa et al. | |
| 7,025,602 | B1 | 4/2006 | Hwang | |
| 7,029,288 | B2 * | 4/2006 | Li | 439/66 |
| 7,131,850 | B2 * | 11/2006 | Frutschy | 439/71 |
| 7,254,889 | B1 * | 8/2007 | Cherian | 29/874 |
| 7,256,593 | B2 | 8/2007 | Treibergs | |
| 7,503,768 | B2 * | 3/2009 | Tutt et al. | 439/66 |
| 7,544,064 | B2 * | 6/2009 | Gilliland | 439/74 |
| 7,722,360 | B2 * | 5/2010 | Millard et al. | 439/66 |

(Continued)

*Primary Examiner* — Neil Abrams

(57) ABSTRACT

A socket connector includes an interconnect assembly having an array of contacts being compressible in a vertical direction and shielding springs surrounding corresponding contacts and being compressible in the vertical direction with the contacts. The shielding springs are electrically grounded and provide electrical shielding for the contacts.

20 Claims, 7 Drawing Sheets

(56) References Cited

U.S. PATENT DOCUMENTS

| | | | | |
|---|---|---|---|---|
| 7,862,391 | B2 | 1/2011 | Johnston et al. | |
| 7,997,907 | B2 * | 8/2011 | Tutt et al. | 439/66 |
| 8,025,531 | B1 * | 9/2011 | Zhang et al. | 439/607.05 |
| 8,210,875 | B2 * | 7/2012 | Tan | 439/607.05 |
| 8,231,416 | B2 | 7/2012 | Johnston et al. | |
| 8,382,488 | B2 * | 2/2013 | Uesaka | 439/66 |
| 8,491,337 | B2 * | 7/2013 | Cai | 439/607.28 |
| 8,523,579 | B2 | 9/2013 | Johnston et al. | |
| 8,535,093 | B1 * | 9/2013 | Mason | 439/607.05 |
| 8,545,237 | B2 * | 10/2013 | Johnson et al. | 439/75 |
| 8,641,449 | B2 * | 2/2014 | Cai | 439/607.1 |
| 8,808,010 | B2 * | 8/2014 | Zhou et al. | 439/66 |
| 8,821,188 | B2 * | 9/2014 | Chang et al. | 439/607.01 |
| 8,851,904 | B2 * | 10/2014 | Chang et al. | 439/71 |
| 8,911,266 | B2 * | 12/2014 | Kawate et al. | 439/700 |
| 8,932,080 | B2 * | 1/2015 | Chang et al. | 439/607.1 |
| 2006/0046533 | A1 * | 3/2006 | Okamoto et al. | 439/74 |
| 2010/0159718 | A1 * | 6/2010 | Duquerroy et al. | 439/66 |
| 2014/0017942 | A1 * | 1/2014 | Mason et al. | 439/607.17 |
| 2014/0154918 | A1 * | 6/2014 | Chang et al. | 439/607.01 |

* cited by examiner

SOCKET CONNECTORS AND METHODS OF ASSEMBLING SOCKET CONNECTORS

BACKGROUND OF THE INVENTION

The subject matter herein relates generally to matter herein relates generally to contacts for use in sockets for interconnecting two electronic components.

Sockets are used to interconnect two electronic components, such as an integrated circuit (IC) component and a printed circuit board (PCB). The sockets typically include an array of contacts held by an insulative socket body. Some known sockets have cantilever beam designs for the contacts. Other known sockets use spring loaded contacts.

Known sockets are not without disadvantages. For example, there is a desire to provide shielding for high speed signal contacts. Typically the sockets provide ground contacts in an array interspersed between corresponding signal contacts to provide shielding for such signal contacts. Providing such ground contacts uses valuable real estate in the socket. For example, some sockets may include 30%-50%, or more, of the contacts as ground contacts.

A need remains for a socket that provides high density and shielding for the signal contacts of the socket.

BRIEF DESCRIPTION OF THE INVENTION

In one embodiment, a socket connector is provided that includes an interconnect assembly having an array of contacts being compressible in a vertical direction and shielding springs surrounding corresponding contacts and being compressible in the vertical direction with the contacts. The shielding springs are electrically grounded and provide electrical shielding for the contacts.

Optionally, the shielding springs may provide 360° shielding around individual corresponding contacts. The shielding springs may be captured between a conductive upper sheet and a conductive lower sheet with the shielding springs electrically connected to the upper and lower sheets to create electrical paths between the upper and lower sheets. The contacts may include upper contacts and lower contacts coupled to corresponding upper contacts with the upper contacts being movable with respect to the lower contacts and the upper contacts engaging the corresponding lower contacts interior of the corresponding shielding springs. The shielding springs may be coil springs helically surrounding corresponding contacts.

In another embodiment, a socket connector is provided including a socket housing having a socket chamber, and an interconnect assembly received in the socket chamber. The interconnect assembly includes an upper sheet that is conductive and has openings therethrough and a lower sheet spaced apart from the upper sheet with a space therebetween that is conductive and has openings therethrough. Upper contact assemblies are received in corresponding openings in the upper sheet. The upper contact assemblies have upper contacts and upper holders that hold the upper contacts and that are coupled to the upper sheet. Lower contact assemblies are received in corresponding openings in the lower sheet. The lower contact assemblies have lower contacts and lower holders that hold the lower contacts and that are coupled to the lower sheet. The lower contacts are electrically connected to corresponding upper contacts within the space. Shielding springs are received in the space and are electrically connected to the upper sheet and the lower sheet. The shielding springs create electrical paths between the upper sheet and the lower sheet. The shielding springs surround corresponding upper contacts and lower contacts to provide electrical shielding for such upper and lower contacts.

In a further embodiment, a method of assembling a socket connector includes positioning a plurality of upper contact assemblies into corresponding openings in an upper sheet, positioning a plurality of lower contact assemblies into corresponding openings in a lower sheet, and positioning a plurality of shielding springs between the upper sheet and the lower sheet with the shielding springs providing electrical paths between the upper sheet and the lower sheet. The shielding springs are positioned to surround corresponding upper and lower contact assemblies to provide electrical shielding for such upper and lower contact assemblies.

DETAILED DESCRIPTION OF SPECIFIC EMBODIMENTS OF THE INVENTION

Figures 1, 2:
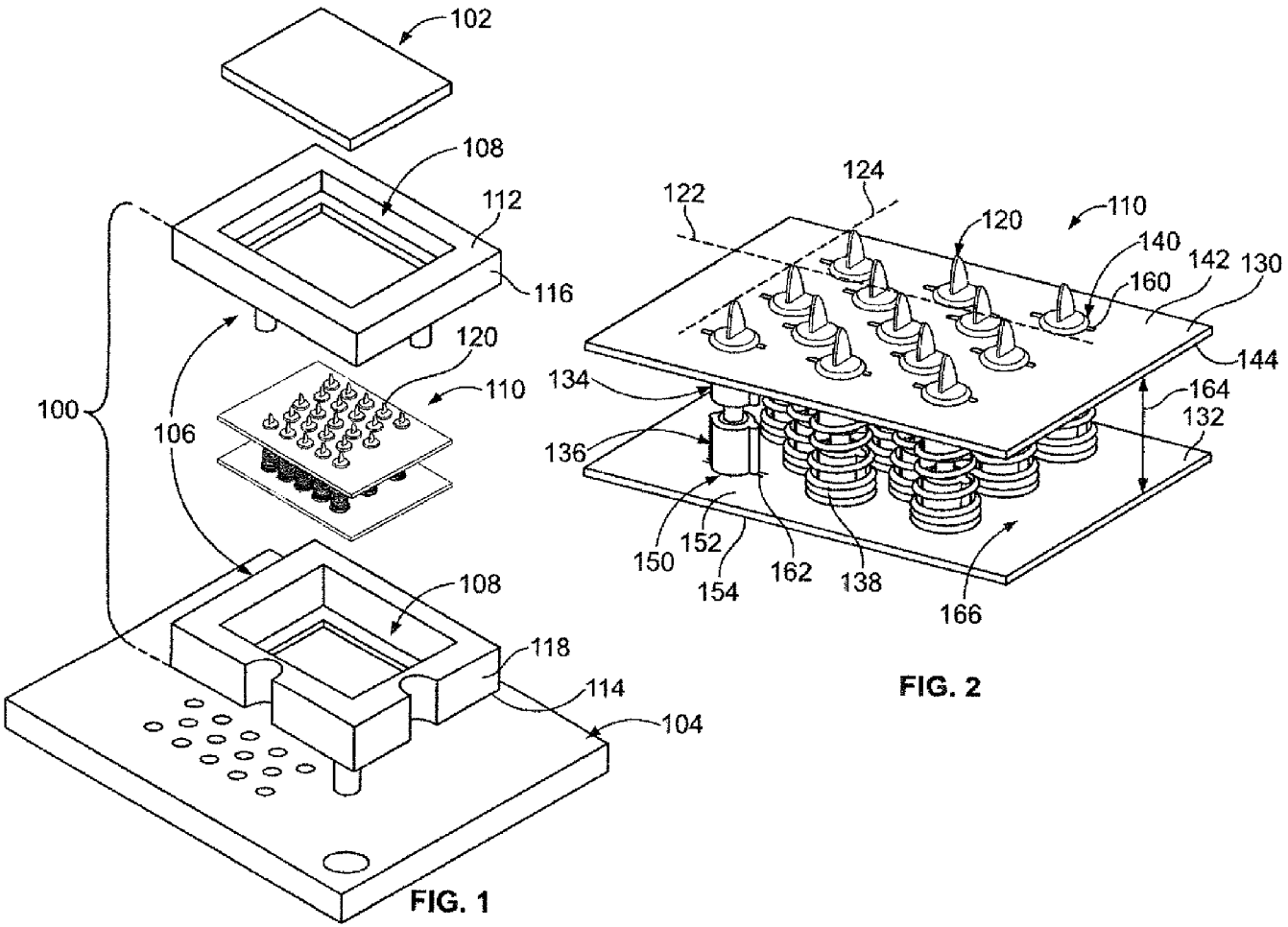
FIG. 1 is an exploded view of a socket connector used to interconnect a first electronic component with a second electronic component.
FIG. 2 is a top perspective view of an interconnect assembly in accordance with an exemplary embodiment.

FIG. 1 is an exploded view of an electronic device 100 used to interconnect a first electronic component 102 with a second electronic component 104. In an exemplary embodiment, the electronic device 100 constitutes a socket connector that may be referred to hereinafter as a socket connector 100. The electronic device 100 may be an interposer or interconnect that is positioned between the first and second electronic components 102, 104 to electrically connect circuits of such components.

In an exemplary embodiment, the socket connector 100 is mated to the first electronic component 102 at a separable mating interface. The socket connector 100 may be repeatedly mated and unmated with the first electronic component 102 or similar electronic components. In an exemplary embodiment, the socket connector 100 may define a test socket for testing an integrated circuit (IC) component or similar type of component. The IC components may be repeatedly tested and removed from the socket connector 100.

The socket connector 100 may be permanently or temporarily coupled to the second electronic component 104 according to various embodiments. For example, solder balls may be provided along the mating interface between the socket connector 100 and the second electronic component 104 to couple the socket connector 100 to the second electronic component 104. Alternatively, the socket connector 100 may be mated to the second electronic component 104 at a separable interface.

The socket connector 100 includes a socket housing 106. The socket housing 106 includes a socket chamber 108 that holds an interconnect assembly 110. The socket chamber 108 is open at a first surface 112 for receiving the first electronic component 102. The interconnect assembly 110 is exposed through the opening at the first surface 112 for mating with the first electronic component 102. The socket housing 106 has a second surface 114. The socket housing 106 may be mounted to the second electronic component 102 at the second surface 114. Alternatively, the second electronic component 102 may be received into the socket chamber 108 through an opening at the second surface 114 for mating with the interconnect assembly 110. In an exemplary embodiment, the socket housing 106 includes an upper frame 116 and a lower frame 118 that are coupled together. The interconnect assembly 110 is held between the upper and lower frames 116, 118.

The interconnect assembly 110 includes an array of contacts 120 that are configured to be mated to corresponding conductors, such as pads, of the electronic components 102, 104 to electrically connect the electronic components 102, 104. The contacts 120 are held by the socket housing 106 in the socket chamber 108. The socket connector 100 may hold any number of contacts 120. The pattern or arrangement of the contacts 120 may correspond with the corresponding contacts or pads on the first and second electronic components 102, 104 to ensure that the contacts 120 are mated to corresponding circuits of the first and second electronic components 102, 104.

In an exemplary embodiment, the contacts 120 are designed to have a tight pitch between adjacent contacts 120. In an exemplary embodiment, the contacts 120 are all signal contacts configured to convey data signals. The interconnect assembly 110 provides electrical shielding for each of the contacts 120 individually such that there is no need for using a subset (e.g. 30-50%) of the contacts as ground contacts to provide electrical shielding between signal contacts. The contacts 120 are designed to be deflectable at the first surface 112 and/or the second surface 114 for mating with the first electronic component 102 and/or the second electronic component 104. The contacts 120 may be designed to have a low compression load for mating the first and/or second electronic components 102, 104 with the socket 100. In an exemplary embodiment, the contacts 120 are designed to be compressible vertically such that the ends of the contacts 120 compress in line with the loading force of the first electronic component 102 and/or the second electronic component 104.

FIG. 2 is a top perspective view of the interconnect assembly 110 in accordance with an exemplary embodiment. The array of contacts 120 are arranged in rows and columns along row axes 122 and column axes 122, respectively. Optionally, the contacts 120 may be rotated at approximately 45° with respect to the row and column axes 122, 124. Optionally, the contacts 120 in adjacent columns are off-set along different rows.

The interconnect assembly 110 includes an upper conductor 130, a lower conductor 132, a plurality of upper contact assemblies 134, a plurality of lower contact assemblies 136 and a plurality of shielding springs 138. One of the shielding springs 138 has been removed to illustrate the upper and lower contact assemblies 134, 136. In the illustrated embodiment, the upper and lower conductors 130, 132 are defined by upper and lower sheets of conductive material, and may be referred to hereinafter as an upper sheet 130 and a lower sheet 132. The upper and/or lower conductors 130, 132 may have different forms in alternative embodiments. For example, the upper conductor 130 may be manufactured from many pieces or parts, such as where portions of the contact assemblies 134 define portions of the upper conductor 130.

The shielding springs 138 are electrically connected to the upper sheet 130 and the lower sheet 132 creating electrical paths between the upper sheet 130 and the lower sheet 132. The shielding springs 138 surround corresponding upper and lower contact assemblies 134, 136 to provide electrical shielding for such upper and lower contact assemblies 134, 136. The upper sheet 130 is a planar structure manufactured from a conductive material, such as aluminum.

The upper sheet 130 includes a plurality of openings 140 extending therethrough. The openings 140 receive corresponding upper contact assemblies 134. The upper sheet 130 includes an outer surface 142 that faces outward and an inner surface 144 that faces inward opposite the outer surface 142. The shielding springs 138 engage the inner surface 144. The shielding springs 138 are electrically connected to the upper sheet 130 at the inner surface 144. The shielding springs 138 are biased against the upper sheet 130 at the inner surface 144.

The lower sheet 132 includes a plurality of openings 150. The openings receive corresponding lower contact assemblies 136. The lower sheet 132 includes an outer surface 152 that faces outward and an inner surface 154 that faces inward. The shielding springs 138 engage the inner surface 154. The shielding springs 138 are electrically connected to the lower sheet 132 at the inner surface 144. The shielding springs 138 are biased against the lower sheet 132 at the inner surface 154.

The upper and lower contact assemblies 134, 136 define the contacts 120 and include dielectric holders to hold the contacts 120. The contacts 120 are electrically isolated from the upper and lower sheets 130, 132 by the dielectric holders of the upper and lower contact assemblies 134, 136, respectively.

In an exemplary embodiment, the upper sheet 130 includes a plurality of beams 160 at the openings 140. The beams 160 may be stamped into the upper sheet 130. The beams 160 engage the upper contact assemblies 134. The beams 160 are deflectable and allow relative movement between the upper contact assemblies 134 and the upper sheet 130. For example, the beams 160 may provide approximately 1 millimeter of movement of the upper contact assembly 134 with respect to the upper sheet 130. Such movement allows for alignment of the contacts 120 with the first electrical component 102 (shown in FIG. 1).

The lower sheet 132 includes a plurality of beams 162 at the openings 140. The beams 162 may be stamped into the lower sheet 132. The beams 162 engage the lower contact assemblies 136. The beams 162 are deflectable and allow relative movement between the lower contact assemblies 136 and the lower sheet 132. For example, the beams 162 may provide approximately 1 millimeter of movement of the lower contact assembly 136 with respect to the lower sheet 132. Such movement allows for alignment of the contacts 120 with the second electrical component 104 (shown in FIG. 1).

The upper sheet 130 is separated from the lower sheet 132 by a distance 164 that defines a space 166. Portions of the upper and lower contact assemblies 134, 136 are received in the space 166. The shielding springs 138 are positioned within the space 166. The upper sheet 130 is movable with respect to the lower sheet 132, such as during mating of the socket connector 100 to the first electronic component 102 and/or the second electronic component 104 (shown in FIG. 1). During mating, the contacts 120 may be compressed in a vertical direction. The shielding springs 138 may be compressed in a vertical direction. The upper sheet 130 and/or the lower sheet 132 may be compressed in a vertical direction. When the shielding springs 138 are compressed, the upper sheet 130 is moved relatively closer to the lower sheet 132 decreasing the distance 164 separating the upper and lower sheets 130, 132. Spring pressure against the upper sheet 130 and/or the lower sheet 132 imparted by the shielding springs 138 ensures that the contacts 120 are pressed against the first and second electronic components 102, 104.

The shielding springs 138 are electrically conductive. For example, the shielding springs 138 may be coated with a conductive coating, such as a silver coating or plating, to enhance the electrical conductivity of the shielding springs 138. The shielding springs 138 engage both the upper sheet 130 and the lower sheet 132 to create electrical paths therebetween. In an exemplary embodiment, the upper sheet 130 and/or the lower sheet 132 may be electrically grounded, and the shielding springs 138, which are electrically connected to the upper and lower sheets 130, 132, are likewise electrically grounded. Such grounding of the shielding springs 138 allows the shielding springs 138 to provide electrical shielding for the contacts 120. In an exemplary embodiment, the shielding springs 138 are coil springs. The shielding springs 138 extend along helical paths surrounding corresponding contacts 120. The shielding springs 138 provide 360° shielding around individual corresponding contacts 120. Optionally, at least some of the contacts 120 may be electrically grounded to the upper conductor 130 and/or the lower conductor 132, such as by using grounding tabs connected thereto or extending therefrom that directly engage the upper conductor 130 and/or lower conductor 132, such as by extending to an exterior of the upper contact assembly 134 and/or the lower contact assembly 136.

Figure 3:
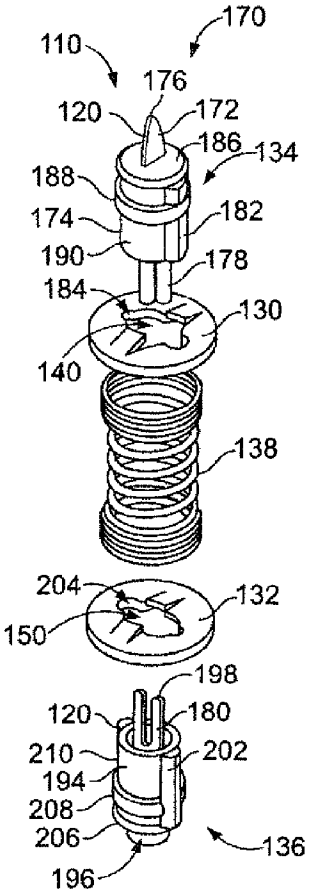
FIG. 3 is an exploded view of a portion of the interconnect assembly.

FIG. 3 is an exploded view of a portion of the interconnect assembly 110 showing one transmission unit 170. The transmission unit 170 includes a single signal contact 120 and a coaxial shield that surrounds the signal contact 120. The coaxial shield is defined by the shielding spring 138 and the upper and lower sheets 130, 132.

The upper contact assembly 134 includes an upper contact 172 and an upper holder 174 that holds the upper contact 172. The upper contact 172 defines a portion of the contact 120. The upper contact 172 has a mating end 176 and a terminating end 178. The mating end 176 defines a separable mating interface for mating with a corresponding conductor, such as a pad, of the first electronic component 102 (shown in FIG. 1). The terminating end 178 is configured to be terminated to a lower contact 180 of the lower contact assembly 136. The upper contact 172 extends vertically between the mating end 176 and the terminating end 178. In an exemplary embodiment, the upper contact 172 may be stamped from a planar sheet with the mating end 176 and the terminating end 178 being coplanar with a plane defined by the upper contact 172. Optionally, the mating end 176 may be rounded to allow for off-axis mating with the first electronic component 102.

The upper holder 174 is manufactured from a dielectric material, such as a plastic material. The upper holder 174 includes an alignment rib 182 for aligning the upper holder 174 with the opening 140 in the upper sheet 130. For example, the upper sheet 130 may include an alignment slot 184 that receives the alignment rib 182. The upper holder 174 includes an outer flange 186 and an inner flange 188. The upper holder 174 is received in the opening 140 such that the upper sheet 130 is captured between the outer flange 186 and the inner flange 188. The upper holder 174 has a base 190 positioned interior of the inner flange 188. The base 190 is configured to be positioned in the space 166 (shown in FIG. 2) between the upper sheet 130 and the lower sheet 132. The shielding spring 138 is fitted around the base 190 to position the shielding spring 138 around the upper contact assembly 134.

The terminating end 178, in the illustrated embodiment, constitutes a tuning fork connection for connecting to the lower contact 180. Other types of interfaces may be provided at the terminating end 178 for electrically connecting the upper contact 172 to the lower contact 180.

The lower contact assembly 136 includes the lower contact 180 and a lower holder 194 that holds the lower contact 180. The lower contact 180 defines a portion of the contact 120. The lower contact 180 has a mating end 196 and a terminating end 198. The mating end 196 defines a separable mating interface for mating with a corresponding conductor, such as a pad, of the second electronic component 104 (shown in FIG. 1). The terminating end 198 is configured to be terminated to the corresponding upper contact 172 of the upper contact assembly 134. The lower contact 180 extends vertically between the mating end 196 and the terminating end 198. In an exemplary embodiment, the lower contact 180 may be stamped from a planar sheet with the mating end 196 and the terminating end 198 being coplanar with a plane defined by the lower contact 180. Optionally, the mating end 196 may be rounded to allow for off-axis mating with the first electronic component 102.

The lower holder 194 is manufactured from a dielectric material, such as a plastic material. The lower holder 194 includes an alignment rib 202 for aligning the lower holder 194 with the opening 150 in the lower sheet 132. For example, the lower sheet 132 may include an alignment slot 204 that receives the alignment rib 202. The lower holder 194 includes an outer flange 206 and an inner flange 208. The lower holder 194 is received in the opening 150 such that the lower sheet 132 is captured between the outer flange 206 and the inner flange 208. The lower holder 194 has a base 210 positioned interior of the inner flange 208. The base 210 is configured to be positioned in the space 166 (shown in FIG. 2) between the upper sheet 130 and the lower sheet 132. The shielding spring 138 is fitted around the base 210 to position the shielding spring 138 around the lower contact assembly 136.

The terminating end 198, in the illustrated embodiment, constitutes a tuning fork connection for connecting to the upper contact 172. Other types of interfaces may be provided at the terminating end 198 for electrically connecting the lower contact 180 to the upper contact 172.

Figure 5:
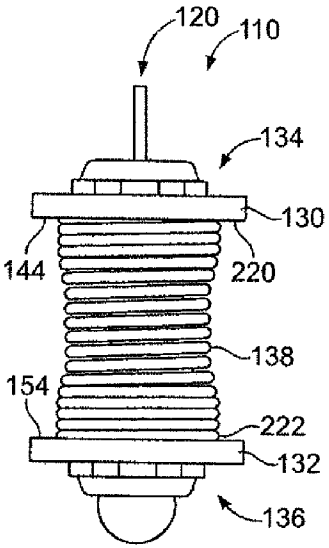
FIG. 5 illustrates a portion of the interconnect assembly in a compressed state.
Figure 4:
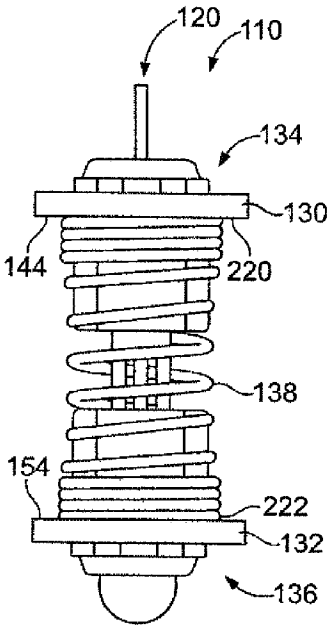
FIG. 4 illustrates a portion of the interconnect assembly in an uncompressed state.

FIG. 4 illustrates a portion of the interconnect assembly 110 in an uncompressed state. FIG. 5 illustrates a portion of the interconnect assembly 110 in a compressed state. When assembled, the upper contact assembly 134 is coupled to the upper sheet 130 and the lower contact assembly 136 is coupled to the lower sheet 132. The shielding spring 138 is positioned between the upper and lower sheets 130, 132 and surrounds the interior portions of the upper and lower contact assemblies 134, 136. Each shielding spring 138 includes an upper edge 220 and a lower edge 222. The upper edge 220 engages the inner surface 144 of the upper sheet 130. The lower edge 222 engages the inner surface 154 of the lower sheet 132. As the interconnect assembly 110 is mated with the first and/or second electronic components 102, 104 the interconnect assembly 110 is compressed from the uncompressed state to the compressed state. The interconnect assembly 110 is compressed vertically along the contacts 120. The electrical path defined by the contact 120 is straight and short.

Figure 6:
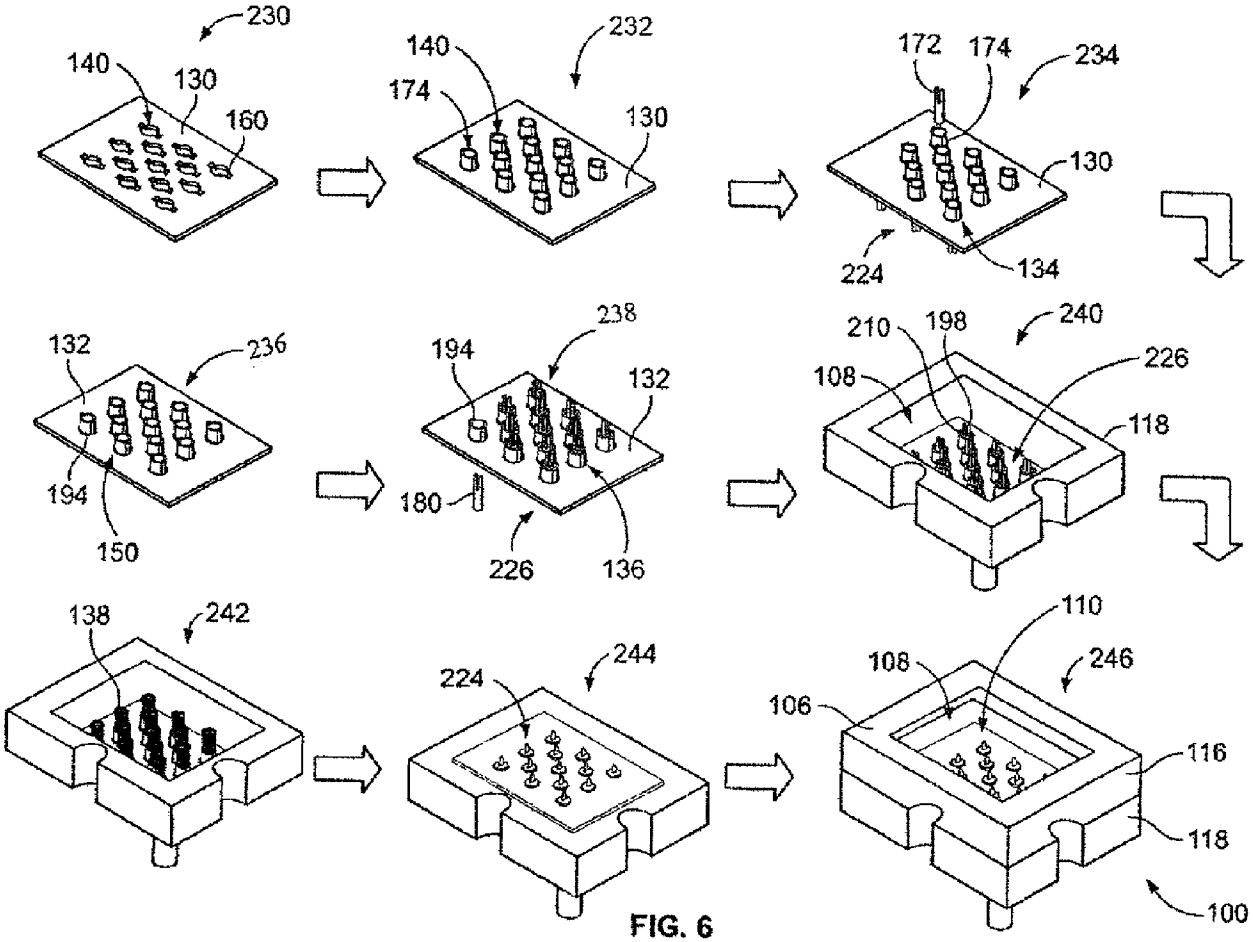
FIG. 6 illustrates a method of assembling a socket connector in accordance with an exemplary embodiment.

FIG. 6 illustrates a method of assembling a socket connector, such as the socket connector 100, in accordance with an exemplary embodiment. At step 230, the upper sheet 130 is provided with a plurality of openings 140. Optionally, the openings 140 may be stamped into the upper sheet 130. Alternatively, the openings 140 may be etched or otherwise removed for the upper sheet 130. The beams 160 may or may not be provided.

At step 232, the upper holders 174 are positioned in the openings 140 of the upper sheet 130. The upper holders 174 may be molded in place in the upper sheet 130. Alternatively, the upper holders 174 may be pre-molded or pre-manufactured and then loaded into the openings 140. Other processes may be used to position the upper holders 174 and the upper sheet 130.

At step 234, the upper contacts 172 are loaded into the upper holders 174. For example, the upper contacts 172 may be stitched into the upper holders 174. In an alternative embodiment, the upper contact 172 may be loaded into the upper holders 174 by other processes. In other alternative embodiments, the upper holder 174 may be molded around the upper contacts 172 prior to loading the upper holders 174 into the upper sheet 130. An upper assembly 224 is defined by the upper sheet 130 and the upper contact assemblies 134.

At step 236, the lower sheet 132 is provided. The lower holders 194 are positioned in the openings 150 in the lower sheet 132. Optionally, the lower holders 194 may be molded in place in the lower sheet 132. Alternatively, the lower holders 194 may be pre-molded or pre-manufactured and then loaded into the openings 150 in the lower sheet 132.

At step 238, the lower contacts 180 are loaded into the lower holder 194. The lower contacts 180 may be stitched into the lower holders 194. The lower contacts 180 may be loaded into the lower holders 194 by other processes in alternative embodiments. In some alternative embodiments, the lower holders 194 may be molded around the lower contacts 180 prior to loading the lower holders 194 into the lower sheet 132. A lower assembly 226 is defined by the lower sheet 132 and the lower contact assemblies 136.

At step 240, the lower assembly 226 is loaded into the lower frame 118. The lower assembly 226 is loaded into the lower frame 118 such that the terminating ends 198 and the bases 210 are upward facing and exposed in the socket chamber 108.

At step 242, the shielding springs 138 are positioned in the socket chamber 108 around the corresponding lower contacts 136. The lower edges 222 (shown in FIG. 4) of the shielding springs 138 rest on the inner surface 154 (shown in FIG. 4) of the lower sheet 132. The shielding springs 138 are positioned to receive the upper contact assemblies 134.

At step 244, the upper assembly 224 is positioned over the lower assembly 226 and the shielding springs 138. The upper contact assemblies 134 are received in corresponding shielding springs 138. The upper assembly 224 is positioned such that the mating ends 176 (shown in FIG. 3) of the upper contacts 172 are upward facing.

At step 246, the upper frame 116 is positioned over the interconnect assembly 110 and the lower frame 118. The upper frame 116 may be secured to the lower frame 118, such as by using fasteners or other securing means. The upper frame 116 and the lower frame 118 capture the inner connect assembly within the socket chamber 108. The socket housing 106 may be mounted to the second electrical component 104 (shown in FIG. 1). The first electronic component 102 (shown in FIG. 1) may be loaded into the socket chamber 108 to interface with the interconnect assembly 110.

Figure 7:
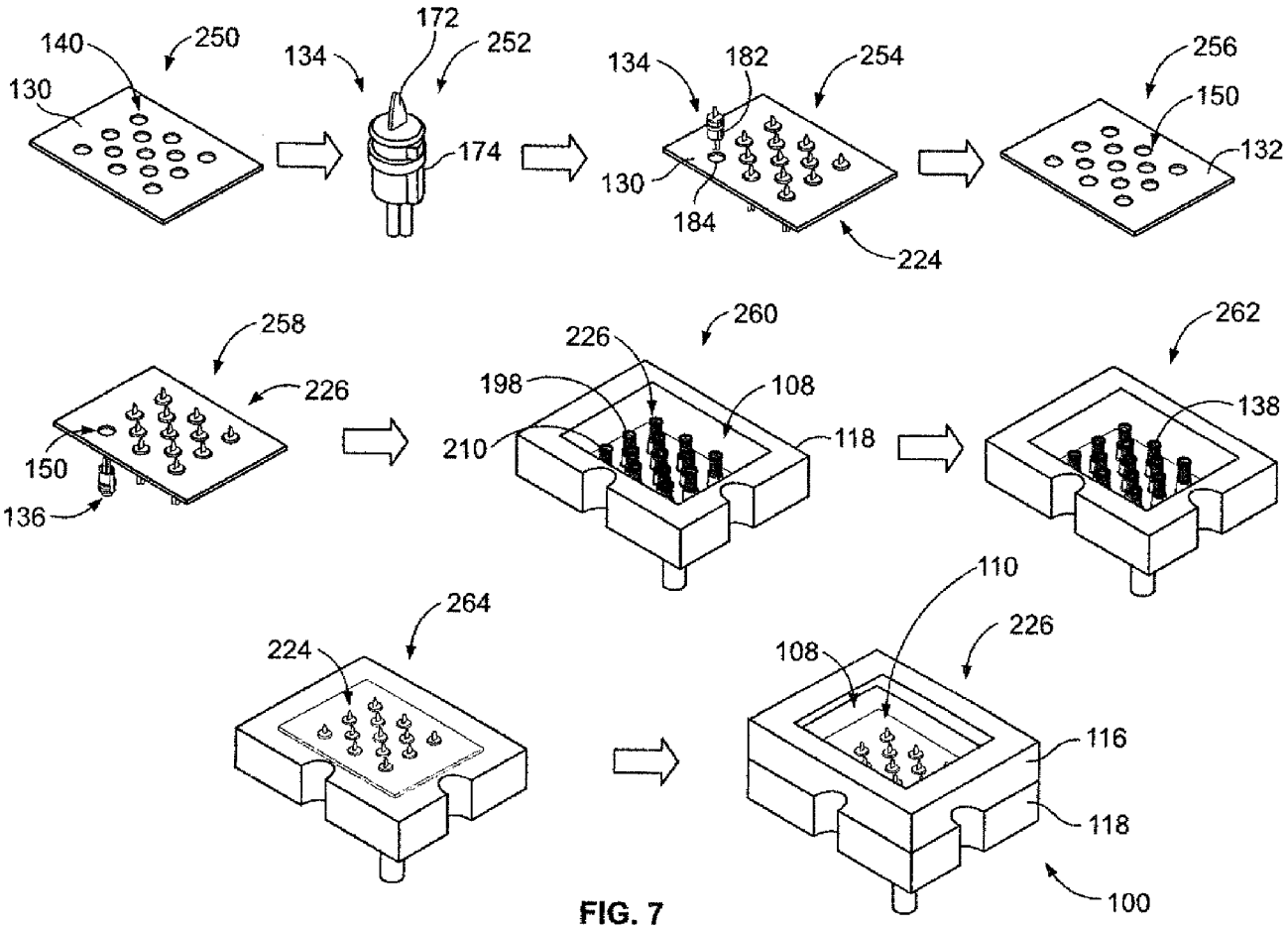
FIG. 7 illustrates a method of assembling a socket connector in accordance with an exemplary embodiment.

FIG. 7 illustrates a method of assembling a socket connector, such as a socket connector 100, in accordance with an exemplary embodiment. At step 250, the upper sheet 130 is provided with a plurality of openings 140. The upper sheet 130 may or may not include the beams 160. At step 252, the upper contact assemblies 134 are assembled. The upper contacts 172 are positioned within the upper holders 174. Optionally, the upper contact 172 may be loaded into a pre-molded or pre-manufactured upper holder 174. Alternatively, the upper holder 174 may be molded around the upper contact 172. At step 254, the upper contact assemblies 134 are loaded into the upper sheet 130. The alignment ribs 182 are received in corresponding alignment slots 184 in the upper sheet 130 to orient the upper contact assemblies 134 with respect to the upper sheet 130.

At step 256 the lower sheet 132 is provided with the openings 150. At step 258, the lower contact assemblies 136 are positioned in the corresponding openings 150 in the lower sheet 132. For example, the lower contact assemblies 136 may be pressed into the openings 150.

At step 260, the lower assembly 226 is loaded into the lower frame 118. The lower assembly 226 is loaded into the lower frame 118 such that the terminating ends 198 and the bases 210 are upward facing and exposed in the socket chamber 108.

At step 262, the shielding springs 138 are positioned in the socket chamber 108 around the corresponding lower contacts 136. The lower edges 222 (shown in FIG. 4) of the shielding springs 138 rest on the inner surface 154 (shown in FIG. 4) of the lower sheet 132. The shielding springs 138 are positioned to receive the upper contact assemblies 134.

At step 264, the upper assembly 224 is positioned over the lower assembly 226 and the shielding springs 138. The upper contact assemblies 134 are received in corresponding shielding springs 138. The upper assembly 224 is positioned such that the mating ends 176 (shown in FIG. 3) of the upper contacts 172 are upward facing.

At step 266, the upper frame 116 is positioned over the interconnect assembly 110 and the lower frame 118. The upper frame 116 may be secured to the lower frame 118, such as by using fasteners or other securing means. The upper frame 116 and the lower frame 118 capture the inner connect assembly within the socket chamber 108. The socket housing 106 may be mounted to the second electrical component 104 (shown in FIG. 1). The first electronic component 102 (shown in FIG. 1) may be loaded into the socket chamber 108 to interface with the interconnect assembly 110.

Figure 8:
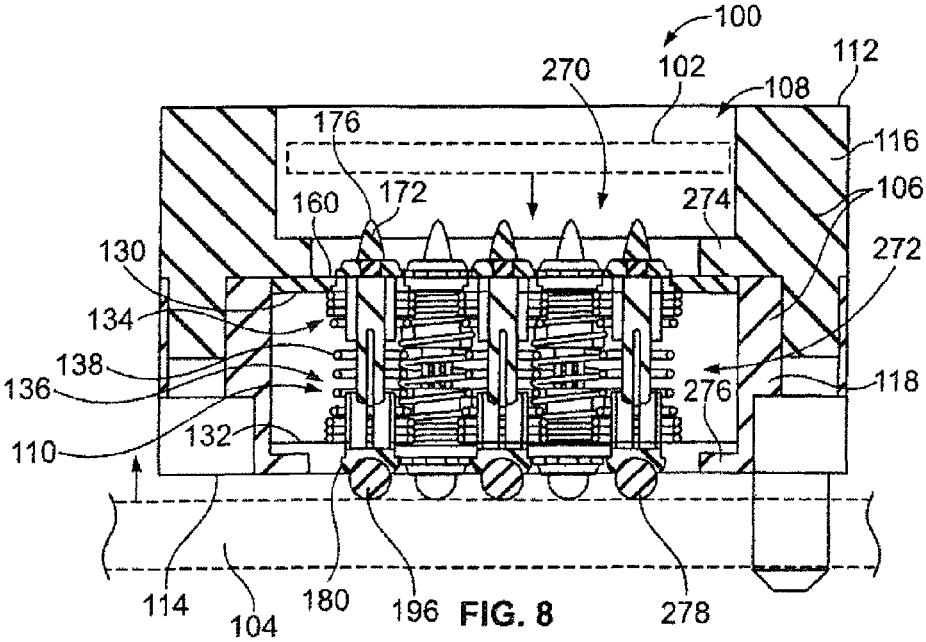
FIG. 8 is a cross sectional view of the socket connector showing the interconnect assembly in an uncompressed state.
Figure 9:
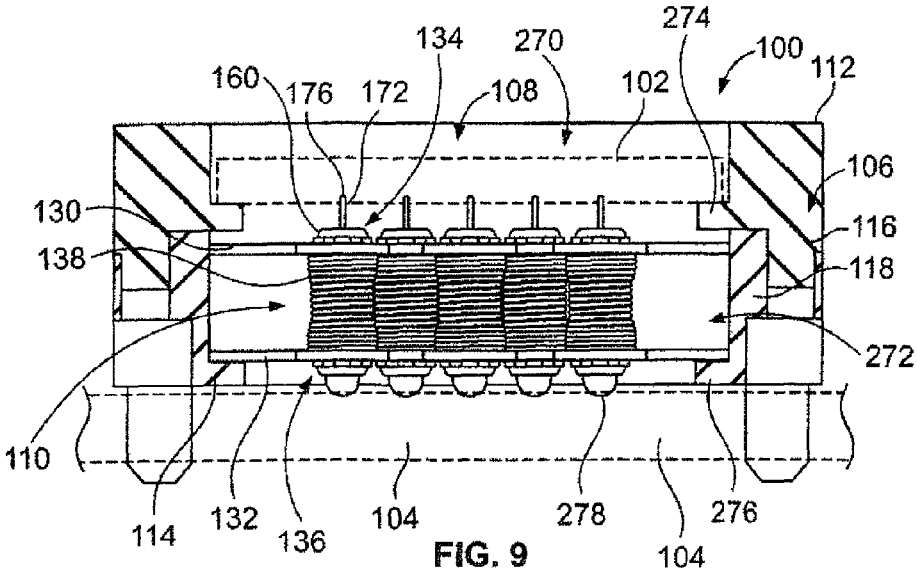
FIG. 9 is a cross sectional view of the socket connector showing the interconnect assembly in a compressed state.

FIG. 8 is a cross sectional view of the socket connector 100 showing the interconnect assembly 110 in an uncompressed state. FIG. 9 is a cross sectional view of the socket connector 100 showing the interconnect assembly 110 in a compressed state. The socket housing 106 includes the socket chamber 108. In an exemplary embodiment, the socket chamber 108 is divided into an upper chamber 270 and a lower chamber 272. The upper chamber 270 is defined between the first surface 112 and a shoulder 274 extending into the socket chamber 108. The shoulder 274 is defined by the upper frame 116. The upper chamber 270 is configured to receive the first electronic component 102 therein. In an exemplary embodiment, portions of the upper contact assemblies 134 extended into the upper chamber 270 for mating with the first electronic component 102. For example, the mating ends 176 of the upper contacts 172 may extend into the upper chamber 270.

The lower chamber 272 is defined between the second surface 114 and the shoulder 274. Optionally, the lower frame 118 may include a shoulder 276 at or near the second surface 114. The interconnect assembly 110 is positioned in the lower chamber 272 between the shoulders 274, 276. In an exemplary embodiment, the lower sheet 132 rests on the lower shoulder 276, while the upper sheet 130 is pressed against the upper shoulder 274 by the shielding springs 138. Optionally, portions of the lower contact assemblies 136 may extend to or beyond the second surface 114 for mounting to the second electronic component 104. For example, solder balls 278 may be provided at the mating ends 196 of the lower contacts 180. The solder balls 278 may extend to or beyond a second surface 114 for mounting to the second electronic component 104. In an alternative embodiment, rather than having solder balls 278, the mating ends 196 may extend to or beyond the second surface 114 for direct engagement with the second electronic component 104. For example, the mating ends 196 may define a separable mating interface with the second electronic component 104.

When the first electronic component 102 is loaded into the upper chamber 270, the interconnect assembly 110 may be compressed into the lower chamber 272. For example, pressure on the upper contact assemblies 134 from the first electronic component 102 may press the upper sheet 130 away from the shoulder 274. The shielding springs 138 impart a spring force in an upward direction against the upper sheet 130, which presses the upper contact assemblies 134 against the first electronic component 102 to maintain an electrical connection between the interconnect assembly 110 and the first electronic component 102. The beams 160 may allow additional, independent movement of each upper contact assembly 134 to accommodate for manufacturing tolerances, bowing of the upper sheet 130 and/or tilting of the upper sheet 130.

Figure 10:
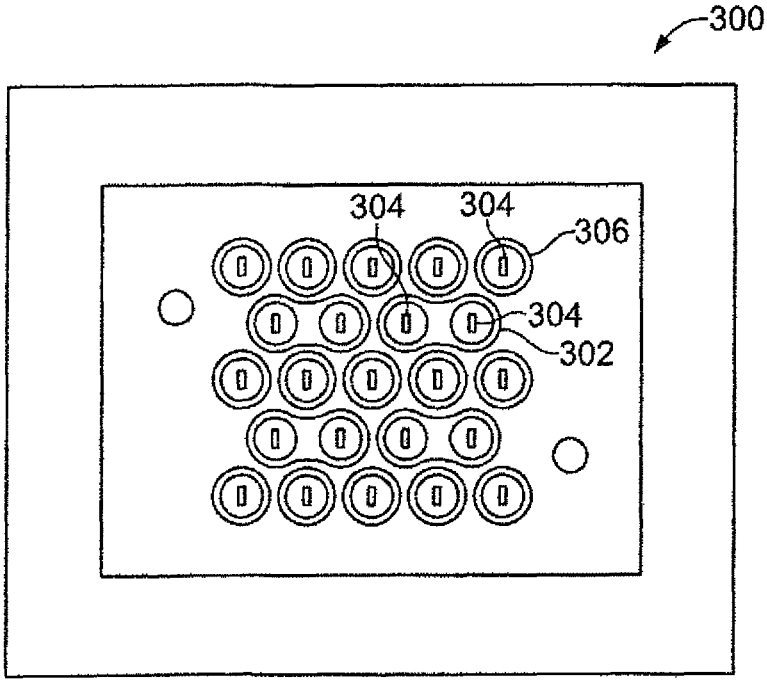
FIG. 10 is a top view of a socket connector formed in accordance with an exemplary embodiment.

FIG. 10 is a top view of a socket connector 300 formed in accordance with an exemplary embodiment. The socket connector 300 is similar to the socket connector 100, however the socket connector 300 includes shielding springs 302 that surround pairs of signal contacts 304. In an exemplary embodiment, some of the signal contacts 304 are arranged in pairs that carry differential signals. Such pairs of signal contacts 304 are surrounded by duel shielding springs 302. The socket connector 300 includes single shielding springs 306 that surround individual signal contacts 304.

Figure 11:
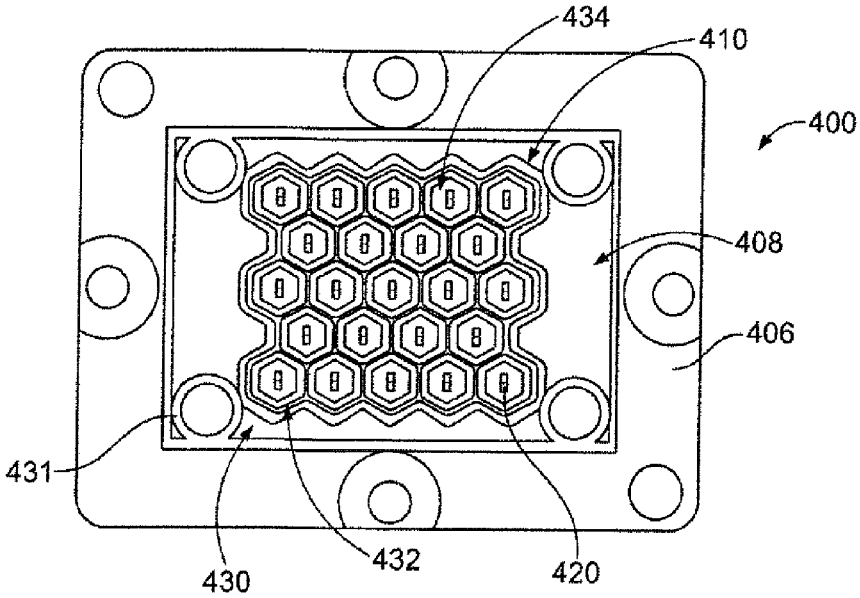
FIG. 11 is a top view of a socket connector formed in accordance with another exemplary embodiment.

FIG. 11 is a top view of an electronic device 400 formed in accordance with an exemplary embodiment. The electronic device 400 is similar to the electronic device 100, however the electronic device 400 includes different types of contact assemblies to form a different type of upper conductor. In an exemplary embodiment, the electronic device 400 constitutes a socket connector, and may be referred to hereinafter as a socket connector 400.

The socket connector 400 includes a socket housing 406. The socket housing 406 includes a socket chamber 408 that holds an interconnect assembly 410. The interconnect assembly 410 includes an array of contacts 420 that are configured to be mated to corresponding conductors, such as pads, of corresponding electronic components (not shown). The interconnect assembly 410 includes an upper conductor 430, defined at least in part by a conductive metal sheet 431. The upper conductor 430 includes an opening 432. The upper conductor 430 may be electrically grounded, such as to the electronic component.

The interconnect assembly 410 includes a plurality of upper contact assemblies 434 received in the opening 432. In an exemplary embodiment, portions of the upper contact assemblies 434 may be electrically conductive and may define portions of the upper conductor 430. The upper contact assemblies 434 are interlocked. For example, the upper contact assemblies 434 may be interdigitated. The upper contact assemblies 434 may be rotationally constrained. Optionally, the upper contact assemblies 434 may have at least one degree of freedom to move relative to other upper contact assemblies 434. For example, the upper contact assemblies 434 may be horizontally locked, but free to move independently in a vertical direction. In an exemplary embodiment, the upper contact assemblies 434 are hexagonally shaped to interlock adjacent upper contact assemblies 434 together. The opening 432 is shaped to interlock with the upper contact assemblies 434. Optionally, the upper contact assemblies 434 may fit snuggly within the opening 432. Optionally, each of the upper contact assemblies 434 may be pressed against at least one adjacent upper contact assembly 434. Conductive portions of the upper contact assemblies 434 may engage each other and be electrically connected to each other and the upper sheet 431.

Figure 12:
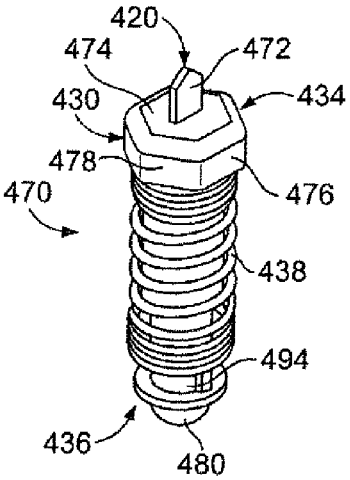
FIG. 12 is a side perspective view of a transmission unit forming a portion of the socket connector shown in FIG. 11.

FIG. 12 is a side perspective view of a transmission unit 470 forming a portion of the interconnect assembly 410 (shown in FIG. 11). The interconnect assembly 410 is defined by a plurality of the transmission units 470 illustrated in FIG. 12. The transmission unit 470 includes the upper contact assembly 434, the contact 420, as well as a lower contact assembly 436 and a shielding spring 438 surrounding the upper and lower contact assemblies 436, 438. The shielding spring 438 is configured to be electrically connected to the conductive portion of the upper contact assembly 436. The shielding spring 438 is configured to be electrically connected to a lower conductor 440 (shown in FIG. 13) to create an electrical path between the upper conductor 430 (shown in FIG. 11) and the lower conductor 440. The shielding spring 438 surrounds the upper and lower contact assemblies 434, 436 to provide electrical shielding for the contact 420 extending through the upper and lower contact assemblies 434, 436. The shielding spring 438 defines a coaxial shield that surrounds the signal contact 420. Optionally, at least some of the contacts 420 may be electrically grounded or shorted to the upper conductor 430 and/or the lower conductor 440, such as by using grounding tabs connected thereto or extending therefrom that directly engage the upper conductor 430 and/or lower conductor 440, such as by extending to an exterior of the upper contact assembly 434 and/or the lower contact assembly 436.

The upper contact assembly 434 includes an upper contact 472 and an upper holder 474 that holds the upper contact 472. The upper contact 472 defines a portion of the contact 420. The upper holder 474 is manufactured from a dielectric material, such as a plastic material. In an exemplary embodiment, a conductive cap 476 is provided on the upper holder 474. The conductive cap 476 may be a separate metal piece that is coupled to the upper holder 474. Alternatively, the conductive cap 476 may be a plating or coating on the upper holder 474. The conductive cap 476 is provided along side edges 478 of the upper holder 474, such that the conductive cap 476 may be electrically coupled to an adjacent upper contact assembly 436 and/or the upper sheet 431 (shown in FIG. 11) in use The lower contact assembly 436 includes the lower contact 480 and a lower holder 494 that holds the lower contact 480. The lower contact assembly 436 may be similar to the lower contact assembly 136 (shown in FIG. 2). Alternatively, the lower contact assembly 436 may be similar to the upper contact assembly 434 such that the lower contact assembly 436 defines a portion of a lower conductor.

Figure 13:
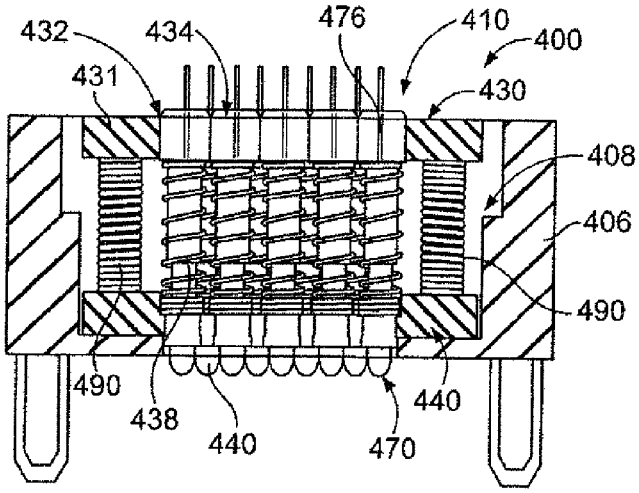
FIG. 13 is a cross sectional view of the socket connector showing an interconnect assembly thereof in an uncompressed state.

FIG. 13 is a cross sectional view of the socket connector 400 showing the interconnect assembly 410 in an uncompressed state. The socket housing 406 includes the socket chamber 408. The lower conductor 440 is received in the socket chamber 408. The lower conductor 440 may be a sheet, plate, block or other structure. The lower conductor 440 is manufactured from a conductive material, such as a metal material. In an exemplary embodiment, the lower conductor 440 includes one or more pockets that receive one or more of the shielding springs 438.

The transmission units 470 are loaded into the socket chamber 408 over the lower conductor 440. Optionally, the transmission units 470 may be loaded into the socket chamber 408 with the lower conductor 440. Side springs 490 are loaded into the socket chamber 408 in the space between the lower conductor 440 and the upper conductor 430. The side springs 490 are electrically conductive and electrically couple the upper and lower conductors 430, 440. The shielding springs 438 extend between the upper and lower conductors 430, 440. The shielding springs 438 electrically couple the upper and lower conductors 430, 440.

The upper contact assemblies 434 are interlocked within the opening 432. The conductive caps 476 of the upper contact assemblies 434 engage each other and/or the upper sheet 431 to electrically connect the conductive caps 476 to each other and to the upper sheet 431. The shielding springs 438 are electrically connected to the upper sheet 431 via the conductive caps 476. The shape of the upper contact assemblies 434 interlock the upper contact assemblies 434 with each other and the upper sheet 431. In an exemplary embodiment, the upper contact assemblies 434 are compressible vertically when mated to the electronic components. Optionally, the upper sheet 431 may be compressed vertically when mated to the electronic components.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A socket connector comprising:

an interconnect assembly having an array of contacts, the contacts being compressible in a vertical direction; and shielding springs surrounding corresponding contacts and being compressible in the vertical direction with the contacts, the shielding springs being electrically grounded, the shielding springs providing electrical shielding for the contacts, wherein the shielding springs are captured between an upper conductor and a lower conductor, the shielding springs being electrically connected to the upper and lower conductors to create electrical paths between the upper and lower conductors.

2. The socket connector of claim 1, wherein the shielding springs provide 360° shielding around individual corresponding contacts.

3. A socket connector comprising:

an interconnect assembly having an array of contacts, the contacts being compressible in a vertical direction, wherein the contacts include upper contacts and lower contacts coupled to corresponding upper contacts, the upper contacts being movable with respect to the lower contacts; and shielding springs surrounding corresponding contacts and being compressible in the vertical direction with the contacts, the shielding springs being electrically grounded, the shielding springs providing electrical shielding for the contacts, the upper contacts engaging the corresponding lower contacts interior of the corresponding shielding springs.

4. The socket connector of claim 1, wherein the shielding springs are coil springs helically surrounding corresponding contacts.

5. The socket connector of claim 3, wherein the shielding springs are captured between an upper conductor and a lower conductor, the shielding springs being electrically connected to the upper and lower conductors to create electrical paths between the upper and lower conductors; and wherein the shielding springs are coil springs helically surrounding corresponding contacts.

6. A socket connector comprising:

a socket housing having a socket chamber; and an interconnect assembly received in the socket chamber, the interconnect assembly comprising:

an upper conductor having at least one opening therethrough;

a lower conductor spaced apart from the upper conductor with a space therebetween, the lower conductor having at least one opening therethrough;

upper contact assemblies received in the at least one opening in the upper conductor, the upper contact assemblies having upper contacts and upper holders that hold the upper contacts, the upper holders being coupled to the upper conductor;

lower contact assemblies received in the at least one opening in the lower conductor, the lower contact assemblies having lower contacts and lower holders that hold the lower contacts, the lower holders being coupled to the lower conductor, the lower contacts being electrically connected to corresponding upper contacts within the space; and shielding springs received in the space, the shielding springs being electrically connected to the upper conductor and the lower conductor, the shielding springs creating electrical paths between the upper conductor and the lower conductor, the shielding springs surrounding corresponding upper contacts and lower contacts to provide electrical shielding for such upper and lower contacts.

7. The socket connector of claim 6, wherein the shielding springs are coil springs helically surrounding corresponding upper and lower contacts.

8. The socket connector of claim 6, wherein the shielding springs provide 360° shielding around individual corresponding upper and lower contacts.

9. The socket connector of claim 6, wherein the upper holders include conductive surfaces defining portions of the upper conductor, the conductive surfaces of adjacent upper holders engaging each other to electrically connect the conductive surfaces of the upper holders.

10. The socket connector of claim 6, wherein at least one of the upper conductor and the lower conductor is movable within the socket chamber as the shielding springs are compressed.

11. The socket connector of claim 6, wherein the upper contacts are compressible in a vertical direction, and wherein the shielding springs are compressible in a vertical direction.

12. The socket connector of claim 6, wherein the upper contacts include mating interfaces and the lower contacts including mating interfaces, the mating interfaces being vertically aligned with corresponding shielding springs.

13. The socket connector of claim 6, wherein the upper conductor includes a sheet having beams at the at least one opening, the beams engaging the upper holders, the beams allowing relative movement between the upper sheet and the upper holders.

14. The socket connector of claim 6, wherein the space is compressed as the shielding springs are compressed.

15. The socket connector of claim 6, wherein the upper holders are interlocked within the at least one opening in the upper conductor, the upper holders defining at least part of the upper conductor, the upper holders being independently movable in vertical directions relative to one another.

16. A method of assembling a socket connector, the method comprising:

positioning a plurality of upper contact assemblies into at least one opening in an upper conductor;

positioning a plurality of lower contact assemblies into at least one opening in a lower conductor; and positioning a plurality of shielding springs between the upper conductor and the lower conductor with the shielding springs providing electrical paths between the upper conductor and the lower conductor, the shielding springs being positioned to surround corresponding upper and lower contact assemblies to provide electrical shielding for such upper and lower contact assemblies.

17. The method of claim 16, wherein said positioning a plurality of upper contact assemblies comprises insert molding upper holders into the at least one opening in the upper conductor and loading upper contacts into the upper holder.

18. The method of claim 16, wherein said positioning a plurality of upper contact assemblies comprises positioning upper contacts in corresponding upper holders to define the upper contact assemblies and loading the upper holders with the upper contacts into the at least one opening in the upper conductor.

19. The method of claim 16, wherein said positioning a plurality of shielding springs comprises loading the shielding springs onto the lower contact assemblies and then positioning the upper conductor and upper contact assemblies over the shielding springs.

20. The method of claim 16, further comprising providing a socket housing, loading the lower conductor and lower contact assemblies into the socket housing, loading the shielding springs into the socket housing onto the lower contact assemblies, and loading the upper conductor and upper contact assemblies into the socket housing with the upper contact assemblies received in corresponding shielding springs.

* * * * *